US005846403A

United States Patent [19]

Swan et al.

[11] Patent Number: 5,846,403

[45] Date of Patent: Dec. 8, 1998

[54] RECRACKING OF CAT NAPHTHA FOR MAXIMIZING LIGHT OLEFINS YIELDS

[75] Inventors: George A. Swan, Baton Rouge, La.; Stephen D. Challis, Fetcham, England

[73] Assignee: Exxon Research and Engineering Company, Florham Park, N.J.

[21] Appl. No.: 768,874

[22] Filed: Dec. 17, 1996

[51] Int. Cl.[6] ..... C01G 11/00

[52] U.S. Cl. ..... 208/113; 208/75; 208/80

[58] Field of Search ..... 208/113, 75, 80

[56] References Cited

U.S. PATENT DOCUMENTS

| | | | |
|---|---|---|---|
| 3,617,497 | 11/1971 | Bryson et al. | 208/80 |
| 3,692,667 | 9/1972 | McKinney et al. | 208/120 |
| 3,928,172 | 12/1975 | Davis et al. | 208/77 |
| 4,051,013 | 9/1977 | Strother | 208/78 |
| 4,892,643 | 1/1990 | Herbst et al. | 208/70 |
| 5,043,522 | 8/1991 | Leyshon et al. | 585/651 |
| 5,318,689 | 6/1994 | Hsing et al. | 208/70 |

*Primary Examiner*—Walter D. Griffin
*Assistant Examiner*—Nadine Preisch
*Attorney, Agent, or Firm*—James H. Takemoto

[57] ABSTRACT

A process for increasing the yield of $C_3$ and $C_4$ olefins by injecting light cat naphtha together with steam into an upstream reaction zone of a FCC riser reactor. The products of the upstream reaction zone are conducted to a downstream reaction zone and combined with fresh feed in the downstream reaction zone.

6 Claims, 1 Drawing Sheet

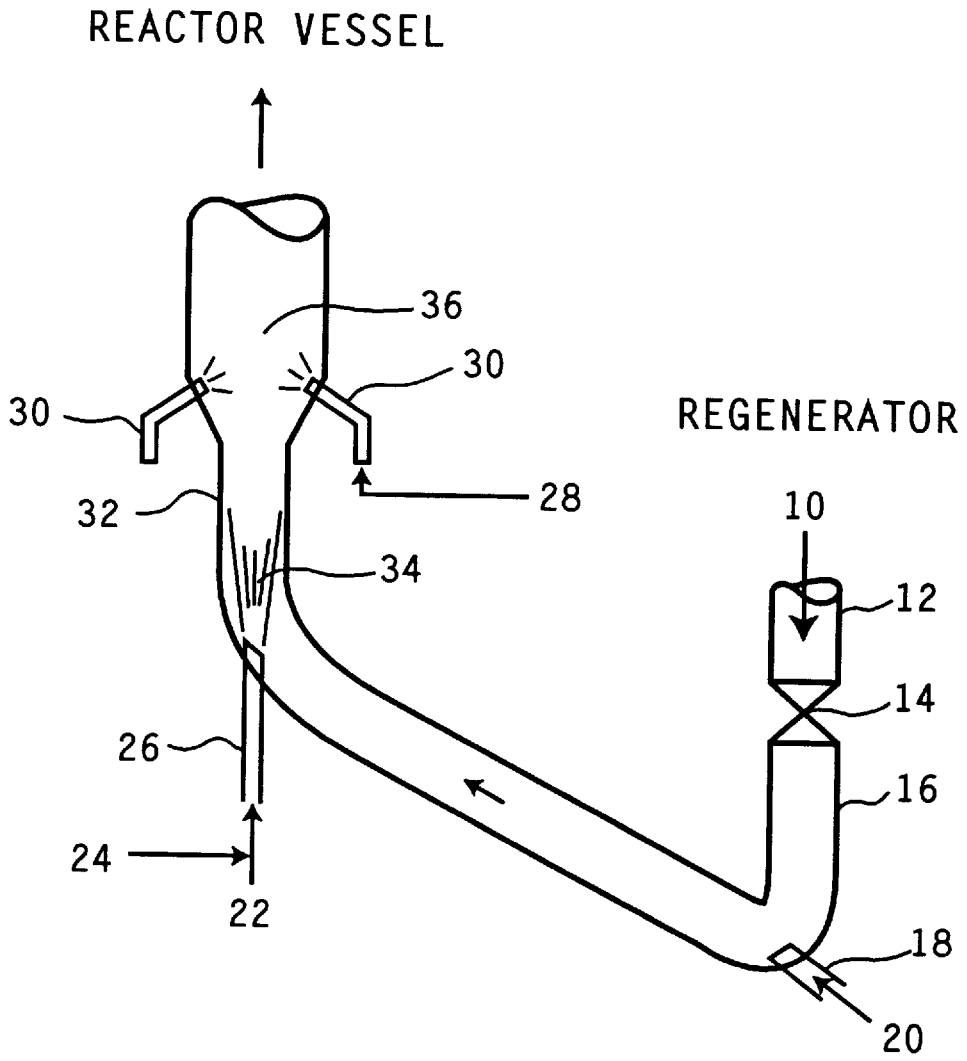
REACTOR VESSEL
36
30
30
REGENERATOR
28
32
10
34
12
14
26
16
24
22
18
20

RECRACKING OF CAT NAPHTHA FOR MAXIMIZING LIGHT OLEFINS YIELDS

FIELD OF THE INVENTION

This invention relates to a fluid catalytic cracking process. More particularly, a light cat naphtha and steam are added to the reaction zone to improve yields of light olefins.

BACKGROUND OF THE INVENTION

Fluid catalytic cracking (FCC) is a well-known method for converting high boiling hydrocarbon feedstocks to lower boiling, more valuable products. In the FCC process, the high boiling feedstock is contacted with a fluidized bed of catalyst particles in the substantial absence of hydrogen at elevated temperatures. The cracking reaction typically occurs in the riser portion of the catalytic cracking reactor. Cracked products are separated from catalyst by means of cyclones and coked catalyst particles are steam-stripped and sent to a regenerator where coke is burned off the catalyst. The regenerated catalyst is then recycled to contact more high boiling feed at the beginning of the riser.

Typical FCC catalysts contain active crystalline aluminosilicates such as zeolites and active inorganic oxide components such as clays of the kaolin type dispersed within an inorganic metal oxide matrix formed from amorphous gels or sols which bind the components together on drying. It is desirable that the matrix be active, attrition resistant, selective with regard to the production of hydrocarbons without excessive coke make and not readily deactivated by metals. Current FCC catalysts may contain in excess of 40 wt. % zeolites.

There is a growing need to utilize heavy streams as feeds to FCC units because such streams are lower cost as compared to more conventional FCC feeds such as gas oils and vacuum gas oils. However, these types of heavy feeds have not been considered desirable because of their high Conradson Carbon (con carbon) content together with high levels of metals such as sodium, iron, nickel and vanadium. Nickel and vanadium lead to excessive "dry gas" production during catalytic cracking. Vanadium, when deposited on zeolite catalysts can migrate to and destroy zeolite catalytic sites. High con carbon feeds lead to excessive coke formation. These factors result in FCC unit operators having to withdraw excessive amounts of catalyst to maintain catalyst activity. This in turn leads to higher costs from fresh catalyst make-up and deactivated catalyst disposal.

U.S. Pat. No. 4,051,013 describes a cat cracking process for simultaneously cracking a gas oil feed and upgrading a gasoline-range feed to produce high quality motor fuel. The gasoline-range feed is contacted with freshly regenerated catalyst in a relatively upstream portion of a short-time dilute-phase riser reactor zone maintained at first catalytic cracking conditions and the gas oil feed is contacted with used catalyst in a relatively downstream portion of the riser reaction zone which is maintained at second catalytic cracking conditions. U.S. Pat. No. 5,043,522 relates to the conversion of paraffinic hydrocarbons to olefins. A saturated paraffin feed is combined with an olefin feed and the mixture contacted with a zeolite catalyst. The feed mixture may also contain steam. U.S. Pat. No. 4,892,643 discloses a cat cracking operation utilizing a single riser reactor in which a relatively high boiling feed is introduced into the riser at a lower level in the presence of a first catalytic cracking catalyst and a naphtha charge is introduced at a higher level in the presence of a second catalytic cracking catalyst.

It would be desirable to have an FCC process which can increase the yield of desirable lower olefins while at the same time increase the octane rating of motor gasoline produced by the FCC process.

SUMMARY OF THE INVENTION

It has been discovered that adding a light cat naphtha and steam to the reaction zone in an FCC process results in improved yields of light olefins. Accordingly, the present invention relates to a fluid catalytic cracking process for upgrading feedstocks to increase yields of $C_3$ and $C_4$ olefins while increasing the octane number of naphtha which comprises:

(a) conducting hot regenerated catalyst to a riser reactor containing a downstream and an upstream reaction zone, (b) contacting hot catalyst with light cat naphtha and steam in the upstream reaction zone at a temperature of from about 620° to 775° C. and a vapor residence time of naphtha and steam of less than 1.5 sec. wherein at least a portion of the $C_5$ to $C_9$ olefins present in the light cat naphtha is cracked to $C_3$ and $C_4$ olefins, (c) contacting the catalyst, cracked naphtha products and steam from the upstream reaction zone with a heavy feedstock in the downstream reaction zone at an initial temperature of from about 600° to 750° C. with vapor residence times of less than about 20 seconds, (d) conducting spent catalyst, cracked products and steam from the first and second reaction zones to a separation zone, (e) separating cracked products including light cat naphtha and steam from spent catalyst and recycling at least a portion of the light cat naphtha product to the upstream reaction zone in step (b), (f) conducting spent catalyst to a stripping zone and stripping spent catalyst under stripping conditions, and (g) conducting stripped spent catalyst to a regeneration zone and regenerating spent catalyst under regeneration conditions.

BRIEF DESCRIPTION OF THE DRAWINGS

The FIGURE is a flow diagram showing the two zone feed injection system in the riser reactor.

DETAILED DESCRIPTION OF THE INVENTION

The catalytic cracking process of this invention provides a method for increasing the production of $C_3$ and $C_4$ olefins while increasing the motor octane rating of naphtha produced from the cat cracking process. These results are achieved by using a two zone injection system for a light cat naphtha and a conventional FCC feedstock in the riser reactor of an FCC unit.

The riser reactor of a typical FCC unit receives hot regenerated catalyst from the regenerator. Fresh catalyst may be included in the catalyst feed to the riser reactor. A lift gas such as air, hydrocarbon vapors or steam may be added to the riser reactor to assist in fluidizing the hot catalyst particles. In the present process, light cat naphtha and steam are added in an upstream zone of the riser reactor. Light cat naphtha refers to a hydrocarbon stream having a final boiling point less than about 140° C. (300° F.) and containing olefins in the $C_5$ to $C_9$ range, single ring, aromatics ($C_6$–$C_9$) and paraffins in the $C_5$ to $C_9$ range. Light cat naphtha (LCN) is injected into the upstream reactor zone together with 2 to 50 wt. %, based on total weight of LCN, of steam. The LCN and steam have a vapor residence time in the upstream zone of less than about 1.5 sec., preferably less than about 1.0 sec with cat/oil ratios of 75–150 (wt/wt) at pressures of 100 to 400 kPa and temperatures in the range of 620°–775° C. The addition of steam and LCN in this upstream zone results in increased $C_3$ and $C_4$ olefins yields by cracking of $C_5$ to $C_9$ olefins in the LCN feed and also results in reduced volume of naphtha having increased octane value. At least about 5 wt. % of the $C_5$ to $C_9$ olefins are converted out of the LCN boiling range to $C_3$ and $C_4$ olefins.

Conventional heavy FCC feedstocks having a boiling point in the 220°–575° C. range such as gas oils and vacuum gas oils are injected in the downstream riser reaction zone. Small amounts (1–15 wt. %) of higher boiling fractions such as vacuum resids may be blended into the conventional feedstocks. Reaction conditions in the downstream reaction zone include initial temperatures of from 600°–750° C. and average temperatures of 525°–575° C. at pressures of from 100–400 kPa and cat/oil ratios of 4–10 (wt/wt) and vapor residence times of 2–20 seconds, preferably less than 6 seconds.

The catalyst which is used in this invention can be any catalyst typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophosphates (ALPOs) and tetrahedral silicoaluminophosphates (SAPOs). More preferably, the crystalline framework oxide component is a zeolite.

Zeolites which can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L. ZK-4, ZK-5, B, E, F, H, J, M, Q, T, W, Z, alpha and beta, ZSM-types and omega.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM #D3907-8). Compounds such as those disclosed in Greensfelder, B. S., et al., *Industrial and Engineering Chemistry,* pp. 2573–83, Nov. 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays as well as α-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides γ-alumina, boehinite, diaspore, and transitional aluminas such as α-alumina, β-alumina, γ-alumina, δ-alumina, ϵ-alumnina, κ-alumina, and ρ-alumina can be employed. Preferably, the alumina species is an aluminum trihydroxide such as gibbsite, bayerite, nordstrandite, or doyelite.

Coked catalyst particles and cracked hydrocarbon products from the upstream and downstream reaction zones in the riser reactor are conducted from the riser reactor into the main reactor vessel which contains cyclones. The cracked hydrocarbon products are separated from coked catalyst particles by the cyclone(s). Coked catalyst particles from the cyclones are conducted to a stripping zone where strippable hydrocarbons are stripped from coked catalyst particles under stripping conditions. In the stripping zone, coked catalyst is typically contacted with steam. Stripped hydrocarbons are combined with cracked hydrocarbon products for further processing.

After the coked catalyst is stripped of strippable hydrocarbon, the catalyst is then conducted to a regenerator. Suitable regeneration temperatures include a temperature ranging from about 1100° to about 1500° F. (593° to about 816° C.), and a pressure ranging from about 0 to about 150 psig (101 to about 1136 kPa). The oxidizing agent used to contact the coked catalyst will generally be an oxygen-containing gas such as air, oxygen and mixtures thereof. The coked catalyst is contacted with the oxidizing agent for a time sufficient to remove, by combustion, at least a portion of the carbonaceous deposit and thereby regenerate the catalyst.

Referring now to the FIGURE, hot catalyst 10 from the regenerator (not shown) is conducted through regenerated catalyst standpipe 12 and slide valve 14 into the "J" bend pipe 16 which connects the regenerator standpipe 12 to the riser reactor 32. Lift gas 20 is injected into pipe 16 through injection nozzle 18 thereby fluidizing hot catalyst particles 10. Steam 24 and light cat naphtha 22 are injected into upstream reaction zone 34 through nozzle 26; multiple injection nozzles may be employed. In reaction zone 34, $C_5$ to $C_9$ olefins are cracked to $C_3$ and $C_4$ olefins. This reaction is favored by short residence times and high temperatures. Cracked hydrocarbon products, partially deactivated catalyst and steam from reaction zone 34 are conducted to downstream reaction zone 36. In reaction zone 36, conventional heavy FCC feedstocks 28 are injected through multiple injection nozzles 30 and combined with the cracked hydrocarbon products, catalyst and steam from reaction zone. Residence times in zone 36 are longer which favor conversion of feed 28. Cracked products from zone 34 and 36 together with coked catalyst and steam are then conducted to the reactor vessel containing cyclones (not shown) where cracked products are separated from coked catalyst particles.

The invention will now be further understood by reference to the following examples.

EXAMPLE 1

This example is directed to the FCC unit operating conditions including reactor and regenerator parameters. The data reported have been adjusted for constant catalyst:oil ratio and to a constant riser outlet temperature. The regenerator was operated in fill burn mode. Table 1 summarizes the base line operating conditions.

TABLE 1

| | |
|---|---|
| Fresh Feed Rate, T/hr[1] | 125–154 |
| Feed Specific Gravity | 0.90–0.92 |
| % 565° C.+ in Feed[2] | 2 |
| LCN Recycle, T/hr | 7.0–10.6 |
| Reactor Temperature, °C. | 520–530 |
| Catalyst Circulation Rate, T/min | 13.8–15.6 |
| Regen Air Rate, $km^3$/hr | 83.5–88.4 |
| Regen Bed Temperature, °C. | 698–708 |
| Coke Burning Rate, T/hr | 6.5–7.7 |
| 221° C.– conversion, wt. % | 67.2–71.8 |

[1]Metric tons/hr.
[2]Fresh feed is a vacuum gas oil containing 2 wt. %, based on feed, of a 565° C.+ resid.

Table 2 contains analytical data on the commercial zeolite catalyst used to gather base line data and in the examples to follow.

TABLE 2

| | |
|---|---|
| MAT Activity[1] | 59 |
| Surface Area, $m^2$/g | 111 |
| Pore Volume, cc/g | 0.40 |
| Average Bulk Density, cc/g | 0.80 |
| $Al_2O_3$, wt. % | 51.3 |
| Na, wt. % | 0.66 |
| Fe, wt. % | 0.47 |
| Ni, wppm | 2030 |
| V, wppm | 4349 |
| $RE_2O_3$, wt. %[2] | 1.27 |
| Average Particle Size, microns | 84 |

[1]Micro Activity Test, ASTM D3907-92
[2]Rare earth oxide

EXAMPLE 2

This example demonstrates the results of injecting light cat naphtha (LCN) together with conventional heavy feedstock in the downstream reaction zone of a riser reactor. This corresponds to injecting LCN through one of the injectors 30 into reaction zone 36 in the FIGURE. The other injectors 30 are used to inject only the conventional feedstock which is a vacuum gas oil containing 2 wt. % of resid having a boiling point of 565° C.+. The reaction conditions are those set forth in Example 1 for a fresh feed rate of 153.9 T/hr and 10.6 T/hr of LCN. The results shown in Table 3 are adjusted to equivalent reactor temperature and catalyst:oil ratio on a total feed basis.

TABLE 3

| Yields, wt. % FF[1] | BASE[2] | LCN Recycle With FCC Feed |
|---|---|---|
| $H_2S$ | 0.38 | 0.39 |
| $H_2$ | 0.12 | 0.12 |
| $C_1$ | 1.20 | 1.22 |
| $C_2$ | 1.09 | 1.11 |
| $C_2$=[3] | 0.94 | 0.97 |
| $C_{2-}$ (ex $H_2S$)[5] | 3.35 | 3.42 |
| $C_3$ | 1.13 | 1.18 |
| $C_3$=[3] | 3.55 | 3.72 |
| $C_4$ | 2.48 | 2.71 |
| $C_4$=[3] | 5.12 | 5.64 |
| LCN (RON/MON) | 19.60 (93.0/79.7) | 17.89 (93.1/79.4) |
| ICN | 12.40 | 12.52 |
| HCN | 8.24 | 8.44 |
| LCO (4) | 6.19 | 6.50 |
| MCO | 3.65 | 3.82 |
| HCO | 18.60 | 17.99 |
| BTMS | 10.78 | 10.76 |
| Coke | 4.55 | 5.01 |
| 221° C.- conv., wt. % | 67.0 | 67.4 |

[1]Yield based on wt. % fresh feed.
[2]Base is fresh feed without any added LCN.
[3]Ethylene, propylene and butytenes, respectively.
[4]Light cycle oil.
[5]$C_{2-}$ is sum of $H_2 + C_1 + C_2 + C_2$=

As can be seen from the data in Table 3, injection of LCN into zone 36 results in an increase in both $C_3$ and $C_4$ olefins over the base case in which no LCN was injected into zone 36. However, $C_{2-}$ dry gas yield increased slightly with LCN recycle into zone 36. LCN from the recycle operation shows a slight RON advantage but a MON debit.

EXAMPLE 3

This example according to the invention demonstrates that the yield of $C_3$ (propylene) olefin can be increased by injection of LCN together with steam into upstream reaction zone 34 in FIG. 1. 124.5 T/hr of fresh feed was injected into reaction zone 36 through nozzles 30. 7.0 T/hr of LCN in admixture with 1.4 T/hr of steam was injected into zone 34 through injection nozzle 26. Comparative yields shown in Table 4, are adjusted as in Example 1 to common reactor temperature and catalyst:oil ratio on a total feed basis.

TABLE 4

| Yields, wt. % FF | BASE | LCN Recycle Upstream of FCC Feed |
|---|---|---|
| $H_2S$ | 0.56 | 0.55 |
| $H_2$ | 0.16 | 0.14 |
| $C_1$ | 1.79 | 1.81 |
| $C_2$ | 1.62 | 1.59 |
| $C_2$= | 1.40 | 1.36 |
| $C_{2-}$ (ex $H_2S$) | 4.97 | 4.90 |
| $C_3$ | 1.44 | 1.49 |
| $C_3$= | 4.31 | 4.72 |
| $C_4$ | 2.56 | 2.86 |
| $C_4$= | 6.50 | 6.95 |
| LCN (RON/MON) | 20.04 (94.2/79.3) | 18.19 (93.2/79.8) |
| ICN | 12.39 | 12.33 |
| HCN | 8.02 | 8.32 |
| LCO | 5.90 | 6.03 |
| MCO | 3.47 | 3.51 |
| HCO | 15.75 | 16.09 |
| BTMS | 8.56 | 8.60 |
| Coke | 5.54 | 5.46 |
| 221° C.- conv., wt. % | 72.2 | 71.8 |

Example 3 shows a 10% increase in propylene yield and 7% increase in butylene yield can be achieved without the expected increases in $C_2$_ dry gas. Recycled LCN composition shifts to higher concentrations of isoparaffins and aromatics resulting in lower RON and higher MON compared to base operation.

TABLE 6

| | A LCN Recycle to Fd Inj[1] | B LCN Recycle to Up Inj[2] | C LCN Recycle to Up Inj[2] |
|---|---|---|---|
| LCN Recycled wt. % FF | 6.9 | 5.6 | 5.3 |
| Equiv. Inject Stream/LCN wt. ratio | 0.09 | 0.19 | 0.43 |
| LCN Converted, wt. %[3] | 25 | 33 | 25 |
| Delta Propylene/LCN Conv, wt. %[4] | 10 | 22 | 24 |
| Delta Butylenes/LCN Conv, wt. % | 30 | 24 | 24 |
| Delta LPG Sats/LCN Conv, wt. % | 16 | 19 | 27 |
| Delta Dry Gas/LCN Conv, wt. % | 4 | −4 | −36 |
| Delta Regenerator Bed Temp, °C.[5] | +1 | −9 | −23 |

[1]LCN recycle added to downstream feedstock reaction zone
[2]LCN recycle added to upstream reaction zone
[3]Based on total LCN recycled
[4]Change in yields vs. corresponding base case without LCN recycle
[5]Change in regenerator bed temperature based on base case with no LCN recycled

EXAMPLE 4

Similar to Example 3, a base operation with 129.2 T/hr of fresh feed was switched to LCN recycle to the upstream reaction zone 34 in the FIGURE. LCN recycle rate was 6.8 T/hr in admixture with 2.95 T/hr of steam injected through injection nozzle 26, and the fresh feed rate was maintained nearly constant. Comparative yields are shown in Table 5 and adjusted to common reactor temperature and catalyst:oil ratio on a total feed basis.

TABLE 5

| Yields, wt. % FF | BASE | LCN Recycle |
|---|---|---|
| $H_2S$ | 0.49 | 0.49 |
| $H_2$ | 0.12 | 0.10 |
| $C_1$ | 1.44 | 1.27 |
| $C_2$ | 1.24 | 1.08 |
| $C_2$= | 1.11 | 0.99 |
| $C_2$ - (ex $H_2S$) | 3.91 | 3.44 |
| $C_3$ | 1.23 | 1.26 |
| $C_3$= | 4.16 | 4.48 |
| $C_4$ | 2.89 | 3.40 |
| $C_4$= | 6.24 | 6.56 |
| LCN | 20.64 | 19.34 |
| RON | 93.0 | 92.8 |
| MON | 79.5 | 80.0 |
| ICN | 12.87 | 13.17 |
| HCN | 8.29 | 8.65 |
| LCO | 6.11 | 6.33 |
| MCO | 3.64 | 3.70 |
| HCO | 15.77 | 16.06 |
| BTMS | 7.81 | 8.04 |
| Coke | 5.94 | 5.08 |
| 221° C.- Conv, wt | 72.8 | 72.2 |

In this example an 8% increase in propylene yield and 5% increase in butylene yield were achieved relative to the base case without LCN recycle, accompanied by a decrease in coke and dry gas which is larger than expected based upon the difference in 221° C.-conversion between the two cases. A significant 0.5 MON boost for the LCN was also observed with a slight debit in RON.

The advantages of LCN recycle of Examples 3 and 4 to the upstream reaction zone as compared to Example 2 where LCN is injected with conventional feed are summarized in Table 6.

As shown in Table 6, the process according to the invention can more selectively convert recycled LCN to propylene with a relative decrease in undesirable dry gas make and a decrease in regenerator temperature. Increasing steam admixed with LCN injected upstream of base FCC significantly reduces $C_2$-dry gas yield while improving propylene selectivity. The decrease in regenerator temperature permits increased resid in the FCC fresh feed, particularly in those FCC units operating near maximum regenerator bed temperature, and also improves catalyst activity maintenance.

What is claimed is:

1. A fluid catalytic cracking process for upgrading feedstocks to increase yields of $C_3$ and $C_4$ olefins while increasing the motor octane number of naphtha which comprises:

(a) conducting hot regenerated catalyst to a riser reactor containing a downstream and an upstream reaction zone, (b) contacting hot catalyst with recycled light cat naphtha product produced by the fluid catalytic cracking process and containing $C_5$ to $C_9$ olefins said product having a final boiling point less than about 140° C. and steam in the upstream reaction zone at a temperature of from about 620° to 775° C and a vapor residence time of naphtha and steam of less than 1.5 sec. wherein at least a portion of the $C_5$ to $C_9$ olefins present in the light cat naphtha is cracked to $C_3$ and $C_4$ olefins, (c) contacting the catalyst, cracked naphtha products and steam from the upstream reaction zone with a feedstock having a boiling point range of from about 220° to 575° C. in the downstream reaction zone at a temperature of from about 600° to 750° C. with vapor residence times of less than about 20 sec., (d) conducting spent catalyst, cracked products and steam from the first and second reaction zones to a separation zone, (e) separating cracked products including light cat naphtha and steam from spent catalyst and recycling at least a portion of the light cat naphtha product with added steam to the upstream reaction zone in step (b), (f) conducting spent catalyst to a stripping zone and stripping spent catalyst under stripping conditions, and (g) conducting stripped spent catalyst to a regeneration zone and regenerating spent catalyst under regeneration conditions.

2. The process of claim 1 wherein the amount of steam in the upstream reaction zone is from 2 to 50 wt. %, based on total weight of light cat naphtha.

3. The process of claim 1 wherein the residence time of naphtha and steam in the upstream reaction zone is less than about 1 sec.

4. The process of claim 1 wherein process conditions in step (b) include catalyst/oil ratios of 75–150 (wt/wt) at pressures of 100–400 kPa.

5. The process of claim 1 wherein process conditions in step (c) include catalyst/oil ratios of 4–10 (wt/wt) at pressures of 100–400 kPa and vapor residence times of 2–20 sec.

6. The process of claim 1 wherein the feedstock in step (c) includes from 1 to 15 wt. %, based on feedstock, of a resid fraction with initial boiling point greater than 565° C.

* * * * *